United States Patent [19]

Whistler, Jr.

[11] 3,984,223

[45] Oct. 5, 1976

[54] REFRIGERATOR CABINET WITH CONDENSER TUBE LOOP IN PARTITION MULLION

[75] Inventor: Charles C. Whistler, Jr., Dayton, Ohio

[73] Assignee: General Motors Corporation, Detroit, Mich.

[22] Filed: Nov. 28, 1975

[21] Appl. No.: 635,885

[52] U.S. Cl. ..... 62/81; 62/277; 62/441

[51] Int. Cl.[2] ..... F25B 41/00; F25B 47/00; F25D 11/02

[58] Field of Search ..... 62/81, 277, 441

[56] References Cited

UNITED STATES PATENTS

| | | | |
|---|---|---|---|
| 2,773,362 | 12/1956 | Scheitlin | 62/277 |
| 3,370,439 | 2/1968 | Rivard et al. | 62/441 |
| 3,403,533 | 10/1968 | Bollenbacher | 62/441 |
| 3,572,051 | 3/1971 | Benasutti | 62/81 |
| 3,893,307 | 7/1975 | Jacobs | 62/441 |

*Primary Examiner*—Lloyd L. King
*Attorney, Agent, or Firm*—Edward P. Barthel

[57] ABSTRACT

A refrigerator cabinet having a one-piece plastic liner wherein the liner is divided by a vertically extending partition into side-by-side compartments with the front face of the partition defining a center vertical mullion provided with a condensation preventing condenser hot gas tube reverse mullion loop, integral with the hot gas tube outer loop installed into the cabinet shell peripheral flange, with the mullion loop extending upwardly from integral torsional portions adjacent the refrigerator shell bottom wall. During manufacture of the refrigerator the one-piece liner is installed by rotating the mullion loop approximately 90° out of the plane of the cabinet shell front access opening by twisting the condenser tube about the torsional portions thereby clearing the access opening for insertion of the one-piece liner. After placing the liner into the cabinet shell the loop is returned to the plane of the front access opening for retention in the mullion.

4 Claims, 10 Drawing Figures

REFRIGERATOR CABINET WITH CONDENSER TUBE LOOP IN PARTITION MULLION

This invention relates to refrigerator cabinet construction together with manufacture of same and is more particularly concerned in the structure and manufacture of cabinets in which a condenser tube mullion loop is provided adjacent the outer face of the cabinet center partition.

Household refrigerators having freezing and fresh food compartments located in side-by-side relationship and separated by an insulating wall commonly have an outer loop of hot refrigerant gas tubing located around the cabinet shell access opening with the outer loop having one end connected to the outlet of the refrigerant condenser and the loop gas exit connected to a refrigerant filter and thence to the evaporator section via a capillary supply tube extending through a suction conduit. The outer loop, throughout its greater portion, is located as close as possible to the outer metal shell flanges in metal-to-metal contact to provide the refrigerator cabinet with an inexpensive efficient heat transfer for using the heat of the condensation of the hot refrigerant gas to prevent condensation of moisture adjacent the front door openings of the cabinet. See prior art U.S. Pat. No. 3,572,051 issued Mar. 23, 1971 to L. D. Benasutti. The construction of side-by-side refrigerator cabinets preferably employ a single integrally molded "one-piece" liner defining the cabinet storage space. In the manufacture of such refrigerators a partition is inserted into the one-piece liner to divide the inner space into a freezer compartment and fresh food compartment and the completed one-piece liner and center partition is thereafter inserted into the cabinet outer shell prior to the insulating of the wall space defined between the one-piece liner and outer shell. It will be understood that the use of the term one-piece liner may include liners wherein the liner and partition are integrally molded as disclosed, for example, in U.S. Pat. No. 3,835,660, issued Sept. 17, 1974 to H. S. Franck.

The present invention has as an object the provision of an improved refrigerator construction which permits the cabinet shell outer condenser loop of hot gas refrigerant tubing to include an integral condenser reverse mullion loop to be located in the plane of the front access opening of the outer shell prior to the insertion of a one-piece liner.

It is another object of the present invention to provide an improved side-by-side refrigerator construction wherein an inexpensive, unitary outer loop of a refrigerant tubing which extends around the sides and top of the outer shell front access opening and also includes a mullion loop behind the center partition front face wherein integral, torsional lengths of tubing along the shell bottom are formed with right-angled bend portions, allowing the mullion loop to be rotated approximately 90° from the plane of the access opening for the insertion of a one-piece refrigerator liner after which the mullion loop is rotated back to the plane of the access opening, thereby insuring that the right-angled bend portions are not overstressed.

It is another object of the present invention to provide an improved method of installing an integral hot gas post condenser tube is a side-by-side refrigerator cabinet with a first outer condenser tube loop surrounding the cabinet access opening, and a second inner loop such that the shell access opening is free to receive a one-piece liner divided into side-by-side compartments by a center partition by the steps of first forming the condenser tube with integral yieldable torsion tube portions adjacent the bottom of the access opening having the unstressed characteristic of causing the inner loop to repose in the plane of the front access opening, rotating the inner loop out of the plane of the front access opening, by twisting the condenser tube along the torsion tube portions through an angle of about 90° to clear the access opening for insertion of the liner, inserting the liner into the cabinet shell, allowing the inner loop to return to the plane of the front access opening for conforming with the liner center partition mullion in response to the untwisting and unstressing of the cndenser tube along the torsion tube portions, and concealing the inner mullion loop in the front of the center partition mullion.

Further objects and advantages of the present invention will be apparent from the following description, reference being had to the accompanying drawings wherein a preferred embodiment of the invention is clearly shown.

Figure 1:
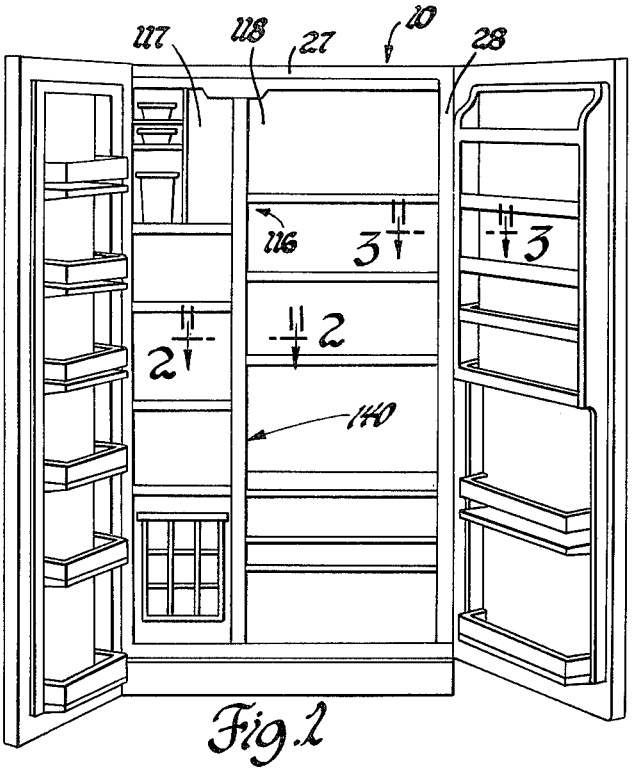
FIG. 1 is a perspective view of a side-by-side refrigerator incorporating the present invention with the refrigerator doors shown in their open position.

Referring to the drawings, for the purpose of illustrating the invention, there is shown in FIG. 1 thereof an insulated side-by-side refrigerator cabinet generally represented by the reference character 10 including a continuous outer sheet metal shell 11 forming outer side walls 12 and 13 and outer top wall 14. These walls are provided with an inturned rear flange (not shown) connected to sheet metal rear panel 15. At the bottom the side walls 12 and 13 are provided with reinforced supporting feet 16 and 17. Within the cabinet shell there is provided a separate sheet metal bottom wall having a lower front portion 20 and a higher rear portion 22 connected by a sloped portion 23. This bottom wall, which includes an upwardly turned flange 24 and return flange 21, is suitably fastened to the side walls 12, 13 and the rear wall 15. The wall portion 20 and flange 24 have a central notched-out area 25 to be explained.

Figure 3:
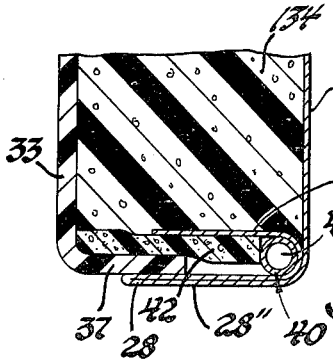
FIG. 3 is an enlarged fragmentary vertical sectional view taken on line 3—3 of FIG. 1.
Figure 4:
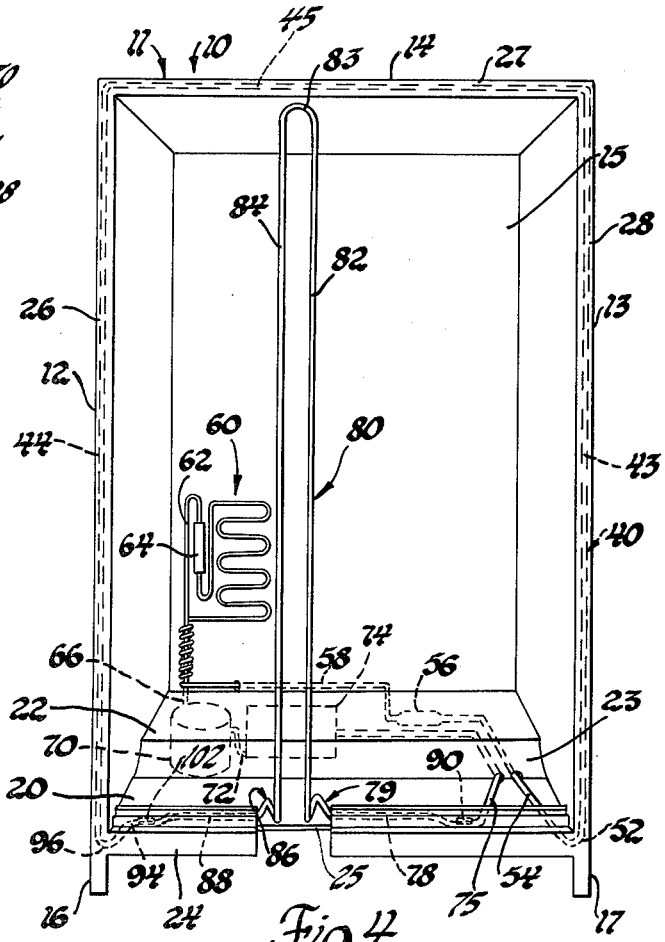
FIG. 4 is a perspective view of the outer shell of the refrigerator cabinet showing a partially schematic representation of the refrigerating components of the refrigerator.

As seen in FIG. 4, the cabinet shell side walls 12 and 13 and top wall 14 are reinforced at the front with inwardly turned flanges 26, 27 and 28 respectively, extending inwardly substantially at right angles to the side and top walls around the door opening. Preferably, this flange is rounded at the corners and formed of a double thickness of metal by being folded back sharply in a manner indicated in FIG. 3. Reference may be had to the refrigerator cabinet disclosed in U.S. Pat. No. 3,572,051 to L. D. Benasutti, issued Mar. 23, 1971, and assigned to the same assignee as the present application for a detailed descussion of such a construction.

Figure 7:
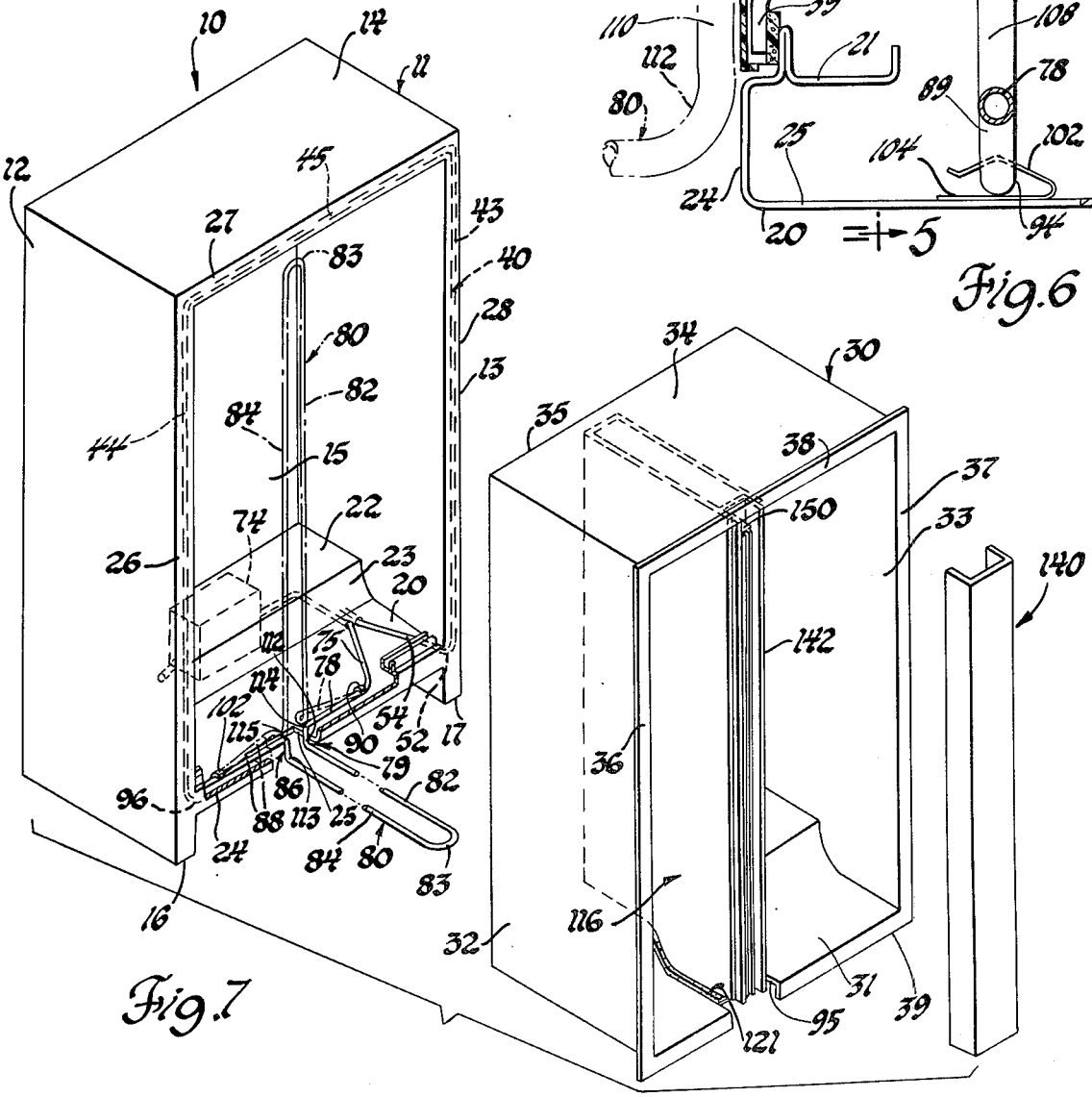
FIG. 7 is an exploded view of the refrigerator cabinet.

As best seen in FIG. 7, the interior of the cabinet is provided with a one-piece box-shaped inner liner 30 preferably formed out of a suitable sheet plastic such as acrylic butadiene styrene (ABS) copolymer having bottom wall 31, side walls 32 and 33, top wall 34 and rear wall 35. The side, top and bottom walls have outturned outer flanges 36, 37, 38 and 39 at the front. In the sectional view of FIG. 3 the outturned liner flange 37 snaps into place between the legs of U-shaped tubular flange arrangement 28 having its open side turned inwardly with an inner flange 28' substantially parallel to outer flange 28''. As explained in the mentioned Benasutti patent, there is lodged tightly within this U-shaped double flange arrangement 26, 27 and 28 an outer first loop of refrigerant tubing, generally indicated at 40, with the tubing having an outer diameter substantially equal to the distance between the flanges 28' and 28''. As detailed in the Benasutti patent, there is inserted into the U-shaped tubular flange arrangement 28 a resilient foam plastic strip 42, preferably foamed from open cell polyethylene, which initially is of uniform thickness and extends slightly more than the distance between the edge of the flange 28' and the vertically extending portion 43 of tubing loop 40.

As seen in FIG. 4, the outer loop 40, which includes vertical side portions 43, 44 and top cross portion 45, has one lower end 52 of portion 43 connected via tubing portion 54 to the inlet of a refrigerant drier-filter 56 while the outlet of the drier-filter 56 is connected by capillary or restrictor tube 58 to the inlet of an evaporator 60 shown on the back wall of the refrigerator cabinet freezer compartment. The outlet of the evaporator 60 is connected by tubing section 62 to an accumulator 64 with the outlet of the accumulator 64 connected by tubing section 66 to the inlet of sealed motor-compressor unit 70. Tubing portion 72 connects the outlet of the motor-compressor unit 70 with the inlet of condenser 74 while the tubing portion 75 connects the outlet of the condenser to a first transversely extending torsion tube portion 78 and a first double-L bend section, generally indicated at 79, to a reverse inner mullion or second loop portion generally indicated at 80.

Figure 5:
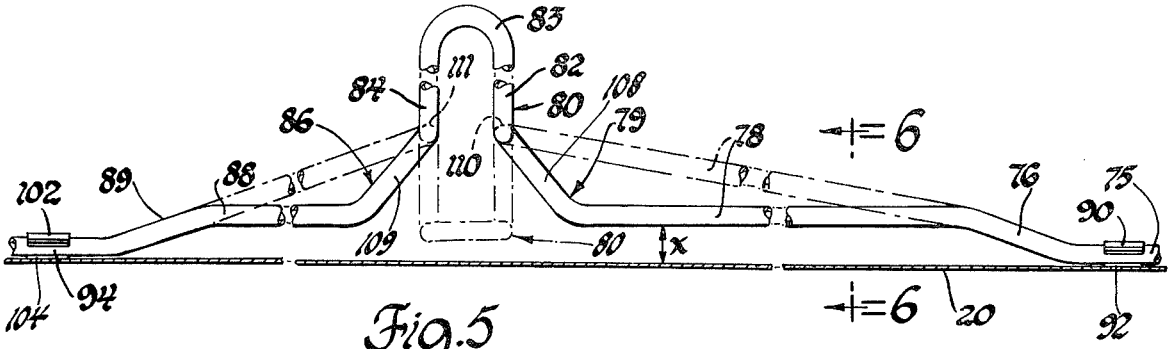
FIG. 5 is an enlarged fragmentary view taken substantially on the line 5—5 of FIG. 6 showing the proportions of the condenser tube along the bottom wall of the refrigerator.
Figure 6:
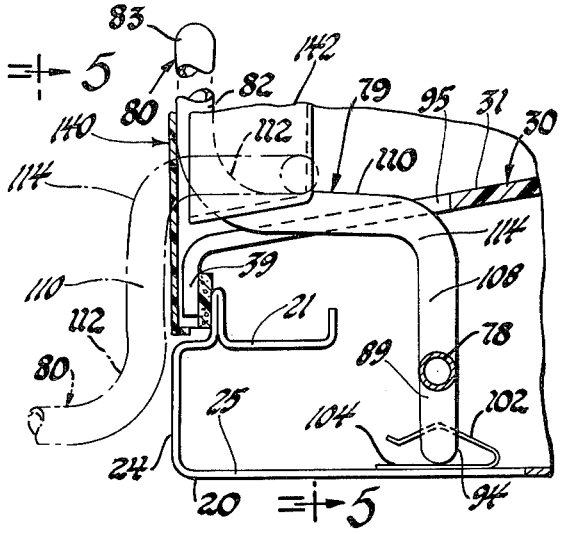
FIG. 6 is a fragmentary vertical sectional view taken on the line 6—6 of FIG. 5 with the insulation omitted for clarity.

As best seen in FIGS. 4 and 7, the reverse mullion loop 80 includes a first vertical portion 82 terminating in a 180° U-shaped bend portion 83 joined to a second vertical tube portion 84; with the lower end of portion 84 joined to a second double-L bend section, generally indicated at 86. As seen in FIGS. 5 and 6, the second double L-bend section 86 is substantially a mirror image of the first double-L bend section 79 while in a like manner a second transversely extending linear torsion tube portion 88 is formed to be a substantial mirror image or first linear torsion tube portion 78.

It will be noted in FIGS. 5 and 6 that both the portions 78 and 88 terminate at their outboard ends in outwardly and downwardly sloped tube portions 76 and 89 respectively, with the portion 78 joining portion 75 contacting the upper surface of cabinet bottom wall 20 and secured thereto by retaining means such as clip member 90 (FIG. 6) with the clip suitably secured, as by welding of its one leg 92 to the upper surface of metal wall 20. The second torsion tube portion 88 is joined by sloped portion 89 and retained tube portion 94 to the outer lower end 96 of the lefthand vertically extending portion 44 of the outer loop 40. A second retaining means, such as clip 102 having its leg 104 welded to wall 20, is shown securing tube portion 94 to the cabinet lower wall 20.

As seen in FIGS. 5–7, the double-L bend sections 79 and 86, extending through liner notch 95, each include inwardly and upwardly sloped portions 108 and 109 and forwardly extending bight portions 110 and 111 respectively, while each double-L bend section has its outer bends 112 and 113 common to and terminating in the mullion loop portions 82 and 84. The inner right angle bend portions 114 and 115 (FIG. 2) of the double-L sections 79 and 86 each terminate in the outwardly extending torsion tube portions 78 and 88 respectively, which are spaced a defined distance "X" above the casing bottom wall 20 which distance in the disclosed form in about ½ inch.

Figure 2:
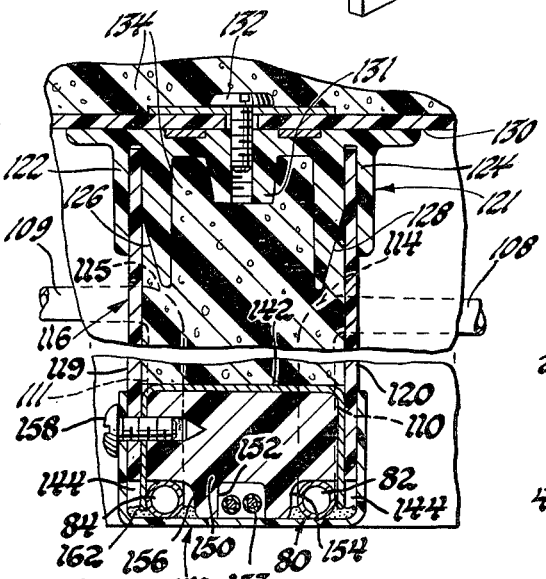
FIG. 2 is an enlarged vertical sectional view taken substantially on the line 2—2 of FIG. 1.

The liner 30 is divided by means of a vertically extending partition 116, into a freezer compartment 117 and a fresh food or above-freezing compartment 118. As seen in FIG. 2, the partition 116 is designed so that it can be filled in the cavity or gaps between its adjacent spaced apart partition walls 119 and 120 during the foaming of the exterior walls of the cabinet. The partition 116 is laterally positioned within the liner by means of a channel-shaped gasket member 121 which, as shown in FIGS. 2 and 7, extends along the bottom, rear and top edges of the partition. The gasket 121 is preferably molded of plastic material and comprises a channel-shaped center portion provided with flanges 122 and 124 having slots 126 and 128 adapted to receive the adjacent edges of the partition walls 119 and 120. FIG. 2 shows gasket 121 on the liner back wall 130 including integral center bosses 131 designed for the reception of threaded fasteners 132 securing the gasket to the rear wall 130 of the liner. Foam insulation 134 is provided between partition walls 119 and 120.

In FIG. 2 the partition is shown with a front mullion channel element 140, preferably molded of plastic, and an inner channel-shaped metal guide 142 extending vertically in telescoped relation to define gaps 144 adapted to receive the adjacent edges of the partition side walls 119 and 120. A body of insulation 150 is provided between the mullion element 140 and inner channel 142 with a center wiring recess 152 for wires 153 provided in the body 150. The insulation body 150 has outer edge recesses 154 and 156 adapted to receive the condenser tube inner loop portions 82 and 84 respectively, prior to the front mullion channel element 140 covering the body 150 to enclose the refrigerant condenser tube portions 82 and 84. The mullion channel element 140 is secured in place by suitable means such as threaded fasteners 158.

Figure 8:
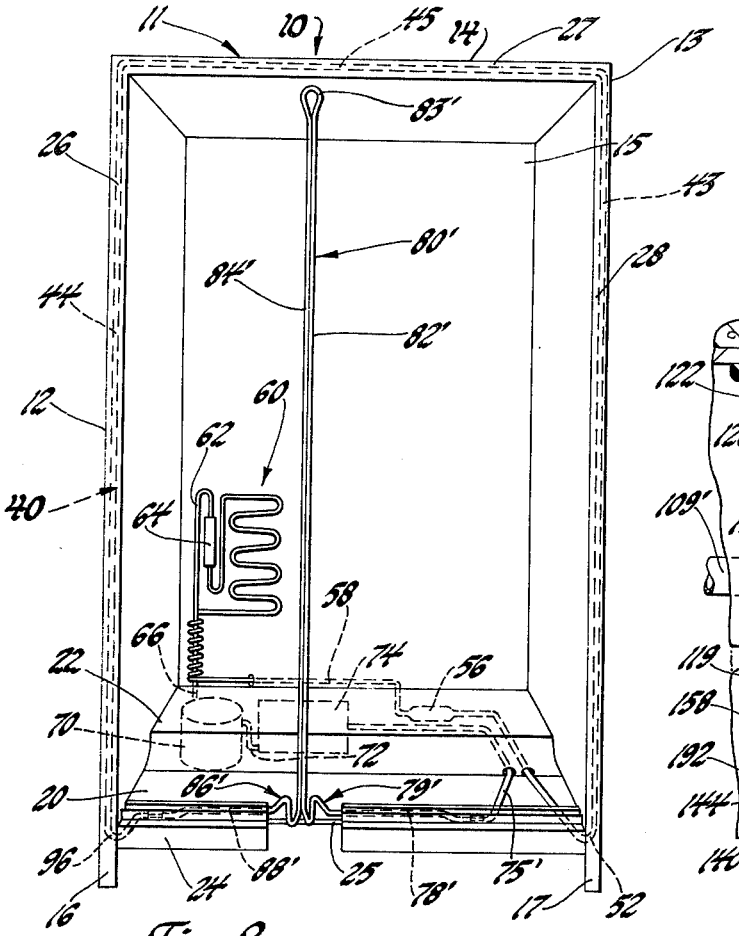
FIGS. 8, 9 and 10 are views similar to FIGS. 4, 2 and 5 respectively, showing a modified form of the invention.
Figure 9:
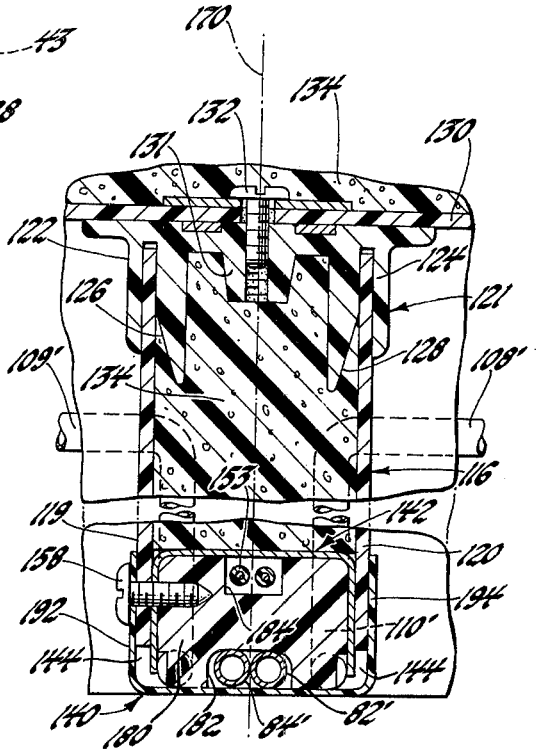
Figure 10:
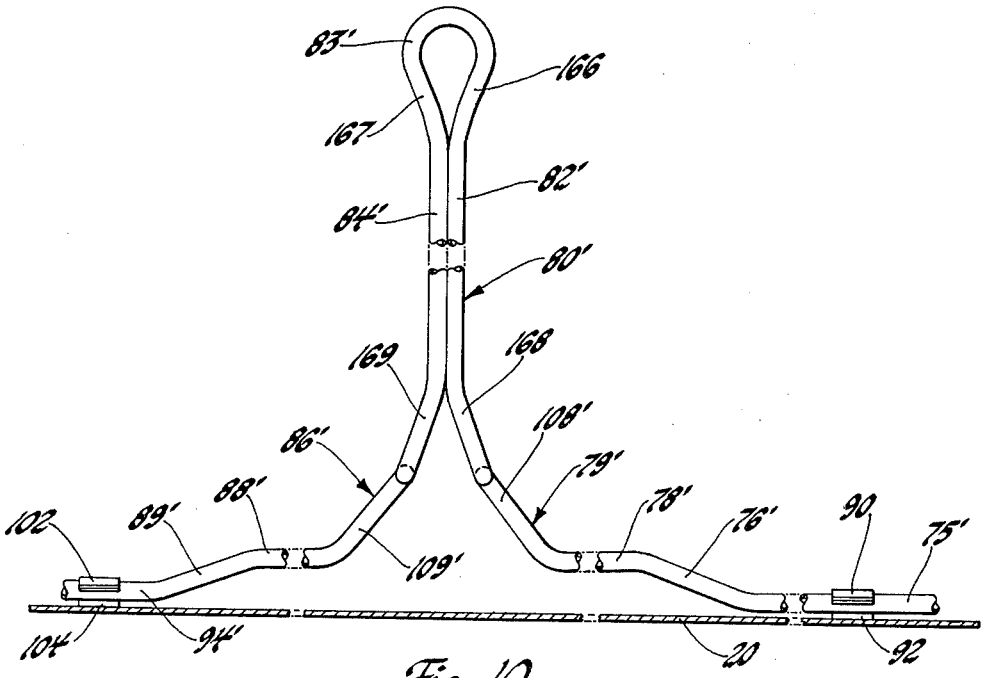

Turning now to FIGS. 8-10 there is shown a modification of the present invention wherein like or corresponding components are shown with the same reference numerals used in FIGS. 1–7, the exception being that each reference numeral for the modified condenser tube is primed. Thus, it will be seen that the modified inner mullion loop 80' has its first and second vertical linear leg portions 82' and 84' formed in juxtaposed relation throughout their extent with the vertical portions 82' and 84' terminating in upper diverging portions 166 and 167 respectively, to connect with the U-shaped bend 83' defining a cotter pin-shaped inner loop. In a similar manner the vertical portions 82' and 84' terminate at their lower ends in diverging portions 168 and 169 to connect with the double-L bend sections 79' and 86' respectively.

As seen in FIG. 9, a modified insulation block or body 180 is provided for the center partition 116 having a single vertical extending notch 182 in its front face for the reception of the linear vertical leg portions 82' and 84' of the inner loop 80'. The block 180 also has a second notch 184 formed in its rear face for accommodating the cabinet electrical lines 153.

It will be appreciated that by virtue of arranging the mullion inner loop 80' with its juxtaposed leg portions 82' and 84' equidistant from the side flanges 192 and 194 of the front mullion channel 140 the heat transfer or leakage from the refrigerator compartments is minimized. Stated differently, the leg portion 82' and 84' are located on either side of the vertical plane of symmetry of the center partition 116 represented by dashed line 170. It has been determined in tests that an electrical energy saving on the order of 5 to 10 percent Killowatt-hours is achieved by the modified form of the invention of FIGS. 8–10 over the form of the invention shown in FIGS. 1–7.

To form the refrigerator cabinet assembly the first step is to install the condenser tube, including integral outer loop 40 and inner mullion loop 80, into the cabinet shell with outer loop 40 located around the shell access opening in the flanges 26, 27 and 28 as shown. Thereafter, the second step involves rotating the inner mullion loop 80 approximately 90° out of the plane of the shell front access opening, defined by outer loop 40, to its solid line position shown in FIG. 7.

The third step is performed with the shell 11 properly positioned, which could be with the shell as shown or in a face-up position, wherein the one-piece liner 30 and partition assembly 116 is inserted or dropped into the shell front access opening and the flanges 37 snapped behind the shell flanges. The fourth step involves installing the channel member 142 and insulation body 150 in the outer end of the center partition 110. At this point in the assembly the condenser tube inner mullion loop 80 is allowed to return through its initial 90° rotation wherein it is again in the plane of the shell access opening for positioning of the tube portions 82 and 84 in the insulation body recesses 142 and 144 and the cabinet electric wires 153 routed in central recess 152.

The next stop involves installing the center vertical partition front mullion channel 140 in place to retain the inner mullion loop portions 82 and 84 in contact with the insulation body 150. As seen in FIG. 2, suitable adhesive means or mastic 162 is used in the preferred form to assist in retaining the mullion channel 140 in place in addition to fasteners 158.

As a final step in the method the cabinet assembly has its insulation space between the walls of the outer shell 11 and one-piece liner 30, together with the partition walls 119 and 120, uniformly filled with a foam insulating material 134 explained, for example, in U.S. Pat. No. 3,137,744 issued June 16, 1964 to P. B. Burrus.

It will be appreciated that the modified form of the invention shown in FIGS. 8–10 with the inner loop 80' having juxtaposed leg portions 82' and 84' is formed by the same method steps as described above for loop 80.

While the embodiment of the present invention as herein disclosed constitutes a preferred form, it is to be understood that other forms might be adopted.

I claim:

1. In a side-by-side insulated refrigerator-freezer cabinet assembly including an outer casing comprising side, top and bottom walls defining an access opening at the front thereof, and an inner liner insertable as one-piece through said access opening to a position spaced from said outer casing and defining a storage chamber including a vertical partition therein dividing the chamber into separate compartments, a refrigeration system for said refrigerator cabinet, an integral fluid conducting tube including a first loop coextensive with the top and sides of said access opening, said integral tube including a second reverse loop extending vertically from a location adjacent the bottom of said access opening substantially coextensive with and enclosed by the forward edge of said partition, said reverse loop having a U-shaped bend located adjacent the top of said access opening, said reverse loop including a pair of double-L bend portions adjacent the casing bottom wall each having a longitudinally extending bight portion, said double-L bend portions having their respective outer bends common to and terminating in said reverse loop, the respective inner bends of the double-L bend portions each terminating in a transversely extending torsion tube portion spaced a defined distance above the casing bottom wall, and means for securing the outer ends of the torsion tube portions to said casing bottom wall, one torsion tube portion outer end joining one lower end of said first loop, a portion of said integral tube extending rearwardly through aperture means in said casing bottom wall to join the outer end of the other torsion tube portion to the outlet of the refrigeration system condenser, and another portion of said integral tube joining the other lower end of said first loop to the inlet of the refrigeration system restrictor means, whereby said reverse loop may be rotated outwardly from the access opening through approximately 90° to allow for the insertion of said one-piece liner with the torsion tube portions being subjected to the major torsional stress insuring the respective double-L bend portions are not overstressed upon said reverse loop being returned to its original vertical position coextensive with the forward edge of the inserted liner center vertical position.

2. In an insulated refrigerator-freezer cabinet assembly including an outer casing comprising side, top and bottom walls defining an access opening at the front thereof, and an inner liner insertable as one-piece through said access opening to a position spaced from said outer casing and defining a storage chamber including a vertical position therein dividing the chamber into separate side-by-side compartments, a refrigeration system for said refrigerator cabinet, an integral heated refrigerant conducting tube including a first outer loop coextensive with the top and sides of said access opening, said integral tube including a second inner reverse bend loop extending vertically from a location adjacent the bottom of said access opening substantially coextensive with and enclosed by the forward edge of said partition, said inner loop reverse bend located adjacent the top of said access opening, said inner loop having its vertical linear leg portions in juxtaposed relation throughout their extent and located on either side of the vertical plane of symmetry of said partition thereby minimizing the flow of heat from said inner loop into said compartments, said inner loop including a pair of right angle bend portions adjacent the casing bottom wall, said right angle bend portions having their respective outer bends common to and terminating in said inner loop, the right angle bend portions each terminating in an outwardly extending torsion tube portion spaced a defined distance above the casing bottom wall, and means for securing the outer ends of the torsion tube portions to said casing bottom wall, whereby said inner loop may be rotated outwardly from the access opening through approximately 90° to allow for the insertion of said one-piece liner with the torsion tube portions being subjected to the major torsional stress insuring the respective right angle bend portions are not overstressed upon said inner loop being returned to its original vertical position coextensive with the forward edge of the inserted liner center vertical partition.

3. In the method of installing a post condenser integral fluid conducing tube into a vertical partition mullion of a side-by-side refrigerator having a cabinet outer shell, a liner insertable into said shell through a front access opening thereof and a refrigeration system including a post condenser tube first loop surrounding said front access opening; which method comprises the steps of forming said condenser integral tube with a second reverse loop portion configured to conform to said mullion and with an integral yieldable torsion portion adjacent an edge of said access opening having the unstressed characteristic of causing said reverse loop portion to repose in the plane of the front access opening of said cabinet shell, pivoting said reverse loop portion out of the plane of said front access opening by twisting and stressing said condenser tube along said torsion portion thereby to clear said access opening for insertion of said liner and vertical partition mullion, inserting said liner and vertical partition mullion into said cabinet shell, returning said reverse loop portion to the plane of said front access opening for conformation with said mullion in response to the untwisting and unstressing of said condenser tube along said torsion portion, and concealing said reverse loop portion in the front of said mullion.

4. In a side-by-side insulated refrigerator-freezer cabinet assembly including an outer casing comprising side, top and bottom walls defining an access opening at the front thereof, and an inner liner insertable as one-piece through said access opening to a position spaced from said outer casing and defining a storage chamber including a vertical position therein dividing the chamber into separate compartments, a refrigeration system for said refrigerator cabinet, an integral heated refrigerant conducting tube including a first outer loop coextensive with the top and sides of said access opening, said integral tube including a second inner reverse loop having a cotter pin-shaped reverse bend extending vertically from a location adjacent the bottom of said access opening substantially coextensive with and enclosed by the forward edge of said partition, said inner loop cotter pin-shaped bend located adjacent the top of said access opening, said inner loop having its vertical linear leg portions in juxtaposed relation throughout their extent and located on either side of the vertical plane of symmetry of said partition thereby minimizing the flow of heat from said inner loop into said compartments, said inner loop including a pair of double-L bend portions adjacent the casing bottom wall each having a longitudinally extending bight portion, said double-L bend portions having their respective outer right angle bends common to and terminating in said inner loop, the respective inner right angle bends of the double-L bend portions each terminating in a transversely extending torsion tube portion spaced a defined distance above the casing bottom wall, and means for securing the outer ends of the torsion tube portions to said casing bottom wall, one torsion tube portion outer end joining one lower end of said first loop, a portion of said integral tube extending rearwardly through aperture means in said casing bottom wall to join the outer end of the other torsion tube portion to the outlet of the refrigeration system condenser, and another portion of said integral tube joining the other lower end of said first loop to the inlet of the refrigeration system restrictor means, whereby said reverse loop may be rotated outwardly from the access opening through approximately 90° to allow for the insertion of said one-piece liner with the torsion tube portions being subjected to the major torsional stress insuring the respective double-L bend portions are not over-stressed upon said reverse loop being returned to its original vertical position coextensive with the forward edge of the inserted liner center vertical position.

* * * * *

UNITED STATES PATENT OFFICE

CERTIFICATE OF CORRECTION

Patent No. 3,984,223 Dated October 5, 1976

Inventor(s) Charles C. Whistler, Jr.

It is certified that error appears in the above-identified patent and that said Letters Patent are hereby corrected as shown below:

Column 1, line 65, "is" should read -- in --.

Column 2, line 15, "cndenser" should read -- condenser --.

Column 3, line 8, "descussion" should read -- discussion --.

Column 4, line 5, "outer" should read -- other --.

Column 5, line 19, "portion" should read -- portions --.

Column 5, line 51, "stop" should read -- step --.

Column 6, line 47, "position" should read -- partition --.

Column 6, line 54, "position" should read -- partition --.

Column 7, line 20, "conducing" should read -- conducting --.

Column 8, line 3, "position" should read -- partition --.

Column 8, line 46, "position" should read -- partition --.

Signed and Sealed this

Eighth Day of March 1977

[SEAL]

*Attest:*

RUTH C. MASON
*Attesting Officer*

C. MARSHALL DANN
*Commissioner of Patents and Trademarks*